US006523225B1

(12) United States Patent
Pečar

(10) Patent No.: US 6,523,225 B1
(45) Date of Patent: Feb. 25, 2003

(54) HINGE ARM MOUNTING

(75) Inventor: David Pečar, Pobegi (SI)

(73) Assignee: Lama D.D. Okovje-Montazni Sistemi-Oeodja-Trgovina, Dekani (SI)

( * ) Notice: Subject to any disclaimer, the term of this patent is extended or adjusted under 35 U.S.C. 154(b) by 0 days.

(21) Appl. No.: 09/926,421

(22) PCT Filed: Apr. 25, 2000

(86) PCT No.: PCT/SI00/00010

§ 371 (c)(1),
(2), (4) Date: Oct. 30, 2001

(87) PCT Pub. No.: WO00/66862

PCT Pub. Date: Nov. 9, 2000

(30) Foreign Application Priority Data

Apr. 30, 1999 (SI) ..... P-9900105

(51) Int. Cl.[7] ..... E05D 5/00; E05D 7/04
(52) U.S. Cl. ..... 16/382; 16/242; 16/246
(58) Field of Search ..... 16/382, 383, 384, 16/242–246, 235–238

(56) References Cited

U.S. PATENT DOCUMENTS 4,367,566 A * 1/1983 Rock et al. ..... 16/236
4,407,044 A * 10/1983 Iseki ..... 16/237
4,718,143 A * 1/1988 Lautenschlager, Jr. ..... 16/238
5,621,947 A * 4/1997 Fitz et al. ..... 16/240
5,781,966 A * 7/1998 Ferrari et al. ..... 16/242
5,930,866 A * 8/1999 Rupprechter ..... 16/235
5,964,010 A * 10/1999 Huber ..... 16/237
6,145,164 A * 11/2000 Ferrari et al. ..... 16/235

FOREIGN PATENT DOCUMENTS

DE 2460127 A * 6/1976
DE 2542462 A * 3/1977
DE 2548153 A * 5/1977
DE 20006086 U * 4/2000

* cited by examiner

*Primary Examiner*—Chuck Y. Mah
(74) *Attorney, Agent, or Firm*—Jacobson Holman PLLC

(57) ABSTRACT

A hinge arm mounting including a match member for engaging a hinge arm and creating a disassembling connection with the latter and a fastening member for mating the match member with their position in relation to each other being adjustable in a direction transverse to a main axis of the hinge arm so that the latter is indirectly fastened to a furniture wall member. The fastening member is placed crosswise to and onto the match member, the former being superimposed on the latter in a middle section of the length of the match member. An eccentric disk member for adjusting the position of the match member in relation to the fastening member in a direction transverse to the main axis of the hinge arm is arranged in a point of intersection of these two members. In their cross-sections, the match member is U-shaped and the fastening member is Ω-shaped. In order to guide the match member against the fastening member when adjusting the position of the match member in relation to the fastening member in a direction transverse to the main axis of the hinge arm, the match member provides an abutment engaged by a free edge of a top plate of the fastening member, and a slot engaged by an overhang of the top plate of the fastening member.

4 Claims, 1 Drawing Sheet

HINGE ARM MOUNTING

Figure 3:
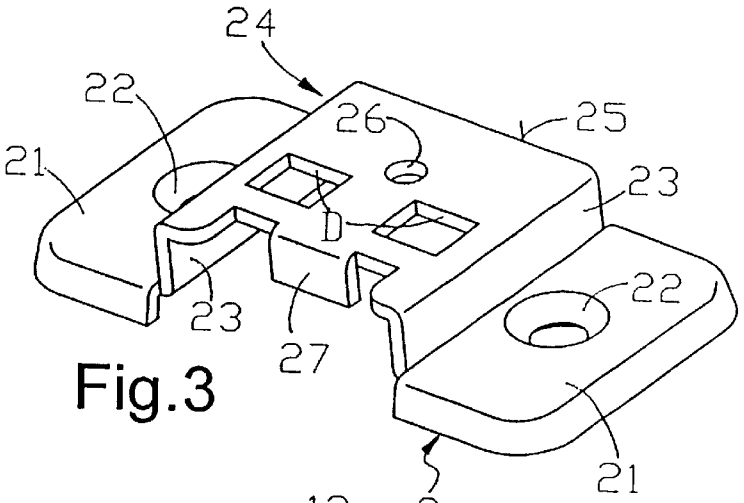

This is a nationalization of PCT/SI00/00010, filed Apr. 25, 2000, and published in English.

The invention relates to a hinge arm mounting comprising a match member for engaging a hinge arm and creating a disassembling connection with the latter and a fastening member for mating said match member, with their position in relation to each other being adjustable in a direction transversely to a main axis of said hinge arm so that said hinge arm is indirectly fastened to a furniture wall member, and with said fastening member being placed onto said match member and an eccentric disk member for adjusting the position of said match member in relation to said fastening member in the direction transversely to said main axis of the hinge arm being arranged centrally.

A hinge arm mounting of the kind set forth above is known from DT 25 42 462 A1. However, said mounting is disadvantageous in that its supporting area of both a fastening member and a match member provides merely an unsatisfactory stability of an applied hinge.

In contrast with the relevant hinge arm mounting mentioned above, a hinge arm mounting of EP 0 790 378 A1 not relating to the mountings of the kind set forth above provides a satisfactory stability of an applied hinge.

It is now an object of this invention to combine advantageous features provided by a central arrangement of an eccentric disk member and the satisfactory stability provided by a hinge arm mounting of the respective technological background.

Proceeding from a hinge arm mounting as defined above in the introduction, the object of the invention is achieved by placing said fastening member crosswise to said match member so that the former is superimposed on the latter merely in a longitudinal middle section of said match member, and said centrally arranged eccentric disk member practically in the point of intersection of said two members.

Actually, the match member is U-shaped and the fastening member is Ω-shaped in their respective cross-sections. No holes (openings, recesses) exist in the leg sections of either the fastening member or the match member, which essentially contributes to the stability of the hinge arm mounting.

In order to guide the match member against the fastening member when adjusting the position of the match member in relation to the fastening member in a direction transversely to said main axis of the hinge arm, the match member provides an abutment engaged by a free edge of a top plate of the fastening member, and a slot engaged by an overhang of said top plate of the fastening member.

Since said eccentric disk member resides essentially in the middle between said abutment and slot of the match member, the mutual guiding of the two mating members is actually a "narrow-gauge" guiding which excludes any canting.

Finally, in order to adjust the position of the match member in relation to the fastening member in a direction transversely to the hinge arm, said eccentric disk member provides a rotary head arranged over said top plate of the fastening member, a pivot section coaxial with said rotary head and arranged in a round-section bearing hole of said top plate of the fastening member, a disk eccentrically connected to said pivot section, the diameter of said disk being equal to the nominal width of an oblong hole of the match member, said oblong hole engaging said disk, and a terminal disk connected to said eccentrically mounted disk and arranged immediately below the inner surface of a top plate of said longitudinal middle section of match member.

An arrangement of the kind set forth above guarantees the provision of an installing length between said rotary head and the terminal disk of said eccentric disk member, whereat said installing length can be defined and repeated so that the intensity of the mating of the fastening member and of the match member can be determined in advance.

Figure 4:
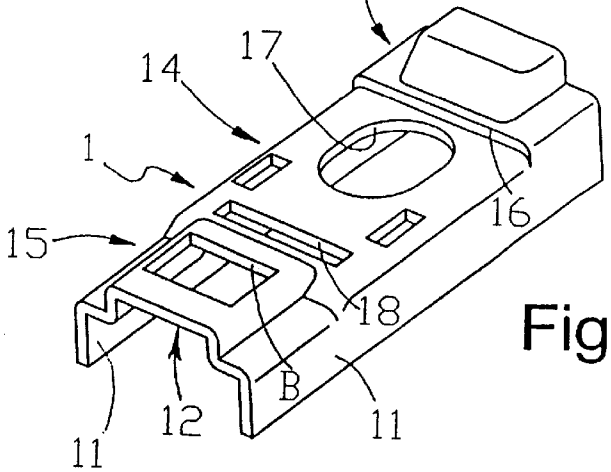
Figure 1:
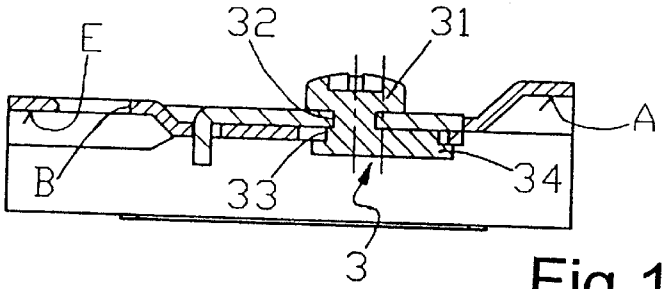
Figure 2:
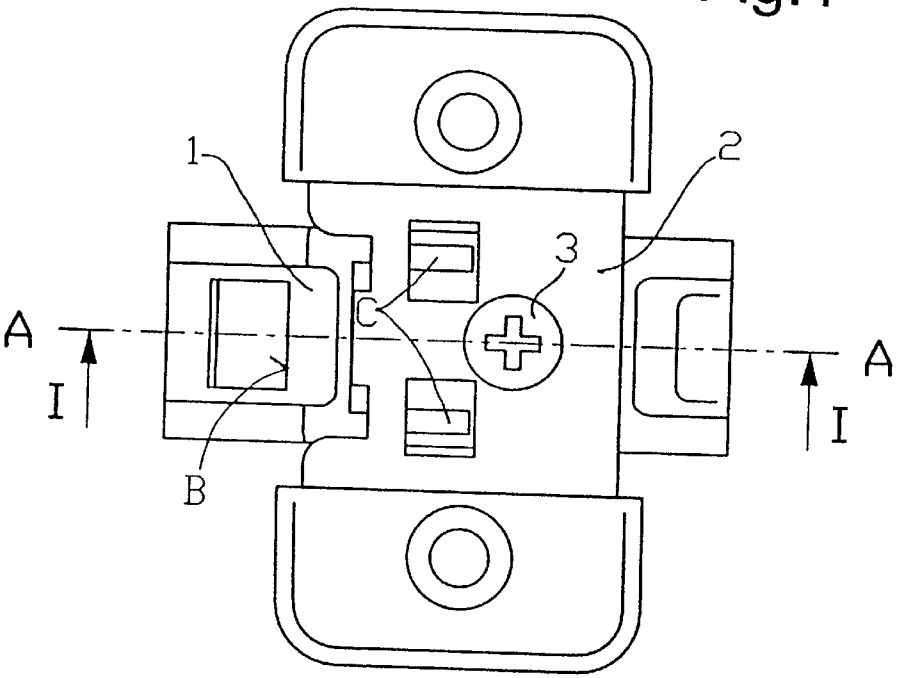

The invention is described in the continuation with reference to the enclosed drawing showing an embodiment of the invention in more detail, the scope of protection, however, is not limited to this embodiment. In the drawing:

FIG. 1 is an elevational view of a longitudinal section of a hinge arm mounting taken along a middle line (line I—I of FIG. 2), FIG. 2 is a top view of the hinge arm mounting of FIG. 1, FIG. 3 is a three-dimensional elevation of a fastening member of the hinge arm mounting, and FIG. 4 is a three-dimensional elevation of a match member of the hinge arm mounting.

A cursory comparison of two embodiments is sufficient for realizing that the suggested hinge arm mounting essentially differs from the one of DT 25 42 462 A1. The match member (a trough member 15 in the prior art) is here an inverted U-profile member (FIG. 4), and the fastening member (a block-shaped fastening member 3 in the prior art) is here an Ω-profile member (FIG. 3). According to the invention, a 'traverse' assembly is a result of assembling a match member 1 and a fastening member 2.

It is an essential feature of the invention that an eccentric disk member 3 is arranged essentially in the point of intersection of the match member 1 and the fastening member 2, i.e. close to the elements constituting a form-closed connection of the fastening member and the match member on the one hand, and of a hinge arm and the hinge arm mounting on the other hand.

In fact, the hinge arm mounting according to the invention is a cross-shaped assembly.

The hinge arm mounting according to the invention is composed of the match member 1, the fastening member 2 traversing it, and the eccentric disk member 3. In an assembled state of the hinge arm mounting, the eccentric disk member 3 conveniently connects said two members 1, 2 to a locked assembly with a single degree of freedom, i.e. with the possibility of the match member 1 to be shifted with respect to the fastening member 2 in parallel with said main axis A—A (FIG. 2) of the hinge arm mounting, said main axis corresponding to the main axis of the hinge arm (not shown).

Basically, the match member 1 is a U-shaped profile, which is, in the assembled state of the hinge arm mounting, by the free edges of its leg sections 11 oriented against a furniture wall member. According to the invention, the leg sections 11 conveniently comprise no openings or recesses that would affect their stability.

The configuration of a top plate 12 of the match member 1 comprises three distinctive longitudinal sections, namely a first-proximal-longitudinal section 13 close to a hinge swivel axis and adapted to engage a first adapter piece of the hinge arm, a second-middle-longitudinal section 14 adapted to be suspended on the fastening member 2 and to operate the eccentric disk member 3 as well as to engage two stabilizing prongs of the hinge arm, and a third-distal-longitudinal section 15 adapted to engage a second-spring-loaded-adapter piece of the hinge arm of a quick-assembling hinge.

The configuration of said first (13) and third (15) longitudinal sections depends on the configuration of the hinge arm (no objective of this invention). When mounting the hinge arm onto the respective hinge arm mounting, a first step relates to inserting said first (stationary) hinge arm adapter piece into a bearing box A (FIG. 1) foreseen close to said hinge swivel axis, then the distal end of the hinge arm is swung against the hinge arm mounting with the stabilizing prongs of hinge arm entering recesses C (FIG. 2) through openings D (FIG. 3), and, finally, said distal spring-loaded hinge arm adapter piece enters a recess B (FIG. 1) and snaps below a cross-bar E.

The configuration of the match member middle section i.e. the second longitudinal section 14 comprises three elements essential for creating the hinge arm mounting, namely an abutment 16 engaged by a free edge 25 of the fastening member 2, a longitudinally arranged oblong hole 17 engaged by a disk 33 (FIG. 1), and a transverse slot 18 engaged by an overhang 27 of the fastening member 2.

The fastening member 2 shaped as an Ω-profile comprises, in a single piece, two flat mounting pieces 21 providing (in this example) two sunk holes 22 for screws (not excluded are other embodiments of fastening taken from prior art) for fastening the hinge arm mounting onto a respective furniture wall member, two leg sections 23 bound thereto and again without any holes or recesses, and a top plate 24 connecting them.

Three elements of the top plate 24 of fastening member 2 are important for the hinge arm mounting, namely the free edge 25 for engaging and slidingly guiding the fastening member 2 in relation to the match member abutment 16 when adjusting the position of the match member 1 in relation to the fastening member 2, a round-section bearing hole 26 co-operating with a pivot section of the eccentric disk member 3, and the overhang 27 bent perpendicularly to the top plate 24 of the fastening member and inserted into the match member transverse slot 18 as well as slidingly guided therein when adjusting the position.

The outer height of the match member leg sections 11 observed at the middle longitudinal section 14 of the match member 1 is a little smaller than the height dimension of a tunnel existing below the top plate 24 of the fastening member 2 (see FIG. 1) so that, when adjusting the hinge arm, the match member 1 practically does not slide on the surface of the furniture wall member.

The eccentric disk member 3 comprises, conveniently in a single piece, a rotary head 31 (providing a groove for the screw driver) residing over the top plate 24 of the fastening member, a pivot section 32 coaxial with it and residing in the bearing hole 26 of the top plate 24 of the fastening member, a disk 33 connected to it and providing a diameter equal to the clearance of the oblong match member hole 17 in which it resides, and a terminal disk 34 connected to the eccentrically mounted disk 33 and arranged immediately below the inner surface of the top plate of the middle section 14 of the match member. Thus, in a clearance between the rotary head 31 on the one hand and the terminal disk 34 on the other hand, the eccentric disk member 3 retains the fastening member 2 and the match member 1 in a locked assembly permitting mutual movement.

What is claimed is:

1. A hinge arm mounting comprising a match member for engaging with and being removably connected to a hinge arm, a fastening member for mating with said match member, with a position of said fastening member being adjustable in a direction transverse to main axis of said match member when said fastening member is placed onto said match member, and an eccentric disk member for adjusting the position of said fastening member in relation to said match member in the direction transverse to said main axis of the match member, wherein said fastening member is placed crosswise to said match member so that the fastening member is superimposed on the match member in a longitudinal middle section of said match member, and said eccentric disk member being centrally arranged in a point of intersection of said match member and said fastening member, the match member providing an abutment engaged by a free edge of a top plate of the fastening member, and a slot engaged by an overhang of the top plate of the fastening member to guide the match member against the fastening member when adjusting the position of the match member in relation to the fastening member in a direction transverse to the main axis.

2. A hinge arm mounting of claim 1, wherein the match member is U-shaped and the fastening member is Ω-shaped in their respective cross-sections.

3. A hinge arm mounting comprising a match member for engaging with and being removably connected to a hinge arm, a fastening member for mating with said match member, with a position of said fastening member being adjustable in a direction transverse to main axis of said match member when said fastening member is placed onto said match member, and an eccentric disk member for adjusting the position of said fastening member in relation to said match member in the direction transverse to said main axis of the match member, wherein said fastening member is placed crosswise to said match member so that the fastening member is superimposed on the match member in a longitudinal middle section of said match member, and said eccentric disk member being centrally arranged in a point of intersection of said match member and said fastening member, the eccentric disk member including a rotary head arranged over a top plate of the fastening member, a pivot section coaxial with said rotary head and arranged in a round-section bearing hole of the top plate, a disk eccentrically connected to the pivot section, the diameter of said disk being equal to a nominal width of an oblong hole of the match member, said oblong hole engaging said disk, and a terminal disk connected to said eccentrically mounted disk and arranged immediately below an inner surface of the top plate of a middle section of the match member to adjust the position of the match member in relation to the fastening member in a direction transverse to the main axis of the match member.

4. A hinge arm mounting of claim 3, wherein the match member is U-shaped and the fastening member is Ω-shaped in their respective cross-sections.

* * * * *